US006088856A

United States Patent [19]

Boyer

[11] Patent Number: 6,088,856

[45] Date of Patent: Jul. 18, 2000

[54] COMBINATION HEAD SUPPORT AND FLUID DISPENSER

[76] Inventor: Jeff Boyer, 4118 Russell Ave. North, Minneapolis, Minn. 55412

[21] Appl. No.: 09/130,728

[22] Filed: Aug. 7, 1998

[51] Int. Cl.[7] ..... A47C 20/02

[52] U.S. Cl. ..... 5/644; 5/654; 5/655.3; 5/655.5; 5/639; 5/645

[58] Field of Search ..... 5/644, 654, 655.3, 5/655.5, 639, 645

[56] References Cited

U.S. PATENT DOCUMENTS

| | | | |
|---|---|---|---|
| 505,873 | 10/1893 | Bomgardner . | |
| 1,707,766 | 4/1929 | Page . | |
| 2,730,151 | 1/1956 | Smith . | |
| 3,263,246 | 8/1966 | Towery . | |
| 3,411,164 | 11/1968 | Sumergrade | 5/644 |
| 4,277,859 | 7/1981 | Seaman | 5/644 X |
| 4,298,103 | 11/1981 | DeFries . | |
| 4,346,298 | 8/1982 | Dixit | 5/644 |
| 4,468,933 | 9/1984 | Christopher . | |
| 4,501,034 | 2/1985 | Greenawalt | 5/644 |
| 4,528,705 | 7/1985 | Greenawalt | 5/644 |
| 4,712,259 | 12/1987 | Chiasson | 5/644 |
| 4,724,560 | 2/1988 | Christie . | |
| 4,921,143 | 5/1990 | Billet | 222/175 |
| 4,928,336 | 5/1990 | Petillo, Sr. | 5/644 |
| 4,932,089 | 6/1990 | Laviero . | |
| 5,119,519 | 6/1992 | Forman . | |
| 5,168,590 | 12/1992 | O'Sullivan . | |
| 5,231,720 | 8/1993 | Benoff | 5/644 |
| 5,385,275 | 1/1995 | Billet | 222/399 |
| 5,450,979 | 9/1995 | Servick et al. | 220/739 |
| 5,819,346 | 10/1998 | Lane | 5/645 X |
| 5,832,550 | 11/1998 | Hauger et al. | 5/644 X |
| 5,918,332 | 7/1999 | Dees | 5/639 |
| 5,921,435 | 7/1999 | Billet | 222/185 |

FOREIGN PATENT DOCUMENTS

| | | | |
|---|---|---|---|
| 2134383 | 8/1984 | United Kingdom | 5/644 |

*Primary Examiner*—Terry Lee Melius
*Assistant Examiner*—Rodrigo J. Morales
*Attorney, Agent, or Firm*—Haugen Law Firm PLLP

[57] ABSTRACT

A versatile pillow having a container and fluid pouch combination for both supporting a user's head and dispensing fluids therefrom. Fluids may be dispensed from the fluid pouch while the container supports the neck and head of the user. The container further includes one or more thermal barriers to thereby insulate the fluids contained within the fluid pouch.

8 Claims, 5 Drawing Sheets

COMBINATION HEAD SUPPORT AND FLUID DISPENSER

BACKGROUND OF THE INVENTION

I. Field of the Invention

This invention relates generally to fluid dispensers, and more particularly relates to a fluid dispenser having a head support, wherein the firmness of the support may be varied. The fluid dispenser includes a padded container and a fluid pouch contained within the padded container. The fluids may be dispensed from the fluid pouch while the container supports the neck and head of the user. The container further includes one or more thermal barriers to thereby insulate the fluids contained within the fluid pouch.

II. Discussion of the Related Art

Over the years, various devices and methods have been used to transport fluids from storage to the point of consumption. Often times these devices are used in the outdoors and must include protective members that protect the device during rugged use. These members may include a hard, rigid, container not particularly well suited for supporting the head or neck of a user. Exemplary of such devices are those shown and described by G. F. Smith in U.S. Pat. No. 2,730,151, and by Christopher in U.S. Pat. No. 4,468,933. These devices include a rigid container for transporting articles therein.

Other devices have been designed as a combination carrying case and pillow. For example, G. Page in U.S. Pat. No. 1,707,766 describes a padded vanity case that may be used to carry perfume bottles, lipstick and the like or alternatively, may be used as a pillow. M. D. Towery in U.S. Pat. No. 3,263,246 describes a beach pillow and bag, wherein the cushioning of the pillow is limited by the articles contained within the bag. These devices are limited in that they may transport items within the bag, however, the user may not readily dispense the items while at the same time utilizing the device as a head support. Further, apparently the described devices enclose solid objects and do not describe features for adequately containing liquids therein.

Other devices have been designed to support the head and neck of the user. These apparatus typically include a cushion enclosed by a flexible material. Although some of these devices utilize a liquid as part of the cushion, the devices are likewise limited in that they do not readily allow the fluids to be dispensed for consumption while at the same time utilizing the device as a head support and further including a thermal barrier between the liquid contained within the device and an outer surface of the device.

Exemplary of such liquid filled pillows are those disclosed by J. Bomgardner in U.S. Pat. No. 505,873, by Christie in U.S. Pat. No. 4,724,560, and by Laviero in U.S. Pat. No. 4,932,089. Both Laviero and Bomgardner describe pillows that include a compartment for containing water and ice, wherein the ice water is described as cooling the head and neck of the user. In this manner, there is a heat transfer between the outer surface and internal fluid compartment of these devices. Hence, there is a need for a fluid container having a head support, wherein the fluids may be dispensed from the container, wherein the container includes a thermal barrier between an exterior and interior of the container.

SUMMARY OF THE INVENTION

The general purpose of the present invention is to provide a combination head support and fluid dispenser operable simultaneously and having a thermal barrier between the exterior and the fluid contained therein, wherein the firmness of the support may be varied while dispensing fluids from the fluid dispenser. The combination head support and fluid dispenser generally includes a container having a flexible exterior shell, an interior liner, and an insulative pad positioned between the exterior shell and interior liner. The container has an inner hollow portion formed therein and has an open end for access to the inner hollow portion. The container further includes a means for closing the open end. Without any limitation intended, the means for closing the open end may include snaps, rivets, buttons, zippers, hook and loop type fasteners, or other fastening mechanisms of known construction suitable to securely close the open end when desired, with a hook and loop type fastener being preferred.

The interior liner is constructed of material having properties sufficient to form a thermal barrier between the insulative pad and inner hollow portion of said container. Without any limitation intended, the liner is preferably constructed of a heat reflective thin flexible film that may be adhered to the insulative pad. In an alternate embodiment, an additional medium, such as a heat reflective thin flexible film, may be positioned between the exterior shell and insulative pad, wherein the medium also has properties sufficient to form a thermal barrier between the exterior shell and insulative pad. In the preferred embodiment the exterior shell, insulative pad and interior liner are constructed of known suitable materials, whereby they may be heat sealed or otherwise adhered together. For example, without any limitation intended, the outer shell is constructed of a nylon fabric, the insulative pad is constructed of polyurethane esther, and the inner liner is constructed of a heat reflective, thin, flexible, metalized plastic film.

A fluid pouch is positioned within the inner hollow portion of said container. The fluid pouch includes an opening or outlet and may alternatively include a separate sealable opening or inlet. Those skilled in the art will appreciate that a single opening may be used both as the fill/refill inlet and outlet. A flexible conduit or tube is sealably attached to the outlet of the fluid pouch and includes a valve coupled to a free end of the tube. The valve is actuated between an open and closed position to thereby control the inward and outward flow of fluids through the tube and fluid pouch. When the fluid pouch is positioned within the inner hollow portion of the container, the tube extends from the fluid pouch through a side opening formed in the container.

The container may additionally include a handle attached to the exterior shell of the container. The handle may have tie downs or other suitable fasteners of known suitable construction to removably affix the flexible tube to the handle at a plurality of points spaced apart on the handle. In an alternate preferred embodiment, the handle includes an interior passage suitable for receiving the tube therein and therethrough. In this manner, the tubing may be concealed within the handle. The container may further include a key chain and outer pocket attached to the exterior shell of said container.

OBJECTS

It is accordingly a principle object of the present invention to provide a versatile pillow combination having both a head support and fluid dispenser both of which are operable simultaneously.

Another object of the present invention is to provide a combination head support and fluid dispenser having a means of controlling both the inward and outward flow of fluids in the head support.

A further object of the present invention is to provide a combination head support and fluid dispenser having a thermal barrier formed between the exterior of the dispenser and a means for containing the fluid within the dispenser.

These and other objects, as well as these and other features and advantages of the present invention will become readily apparent to those skilled in the art from a review of the following detailed description of the preferred embodiment in conjunction with the accompanying claims and drawings in which like numerals in the several views refer to corresponding parts.

DETAILED DESCRIPTION

Figure 1:
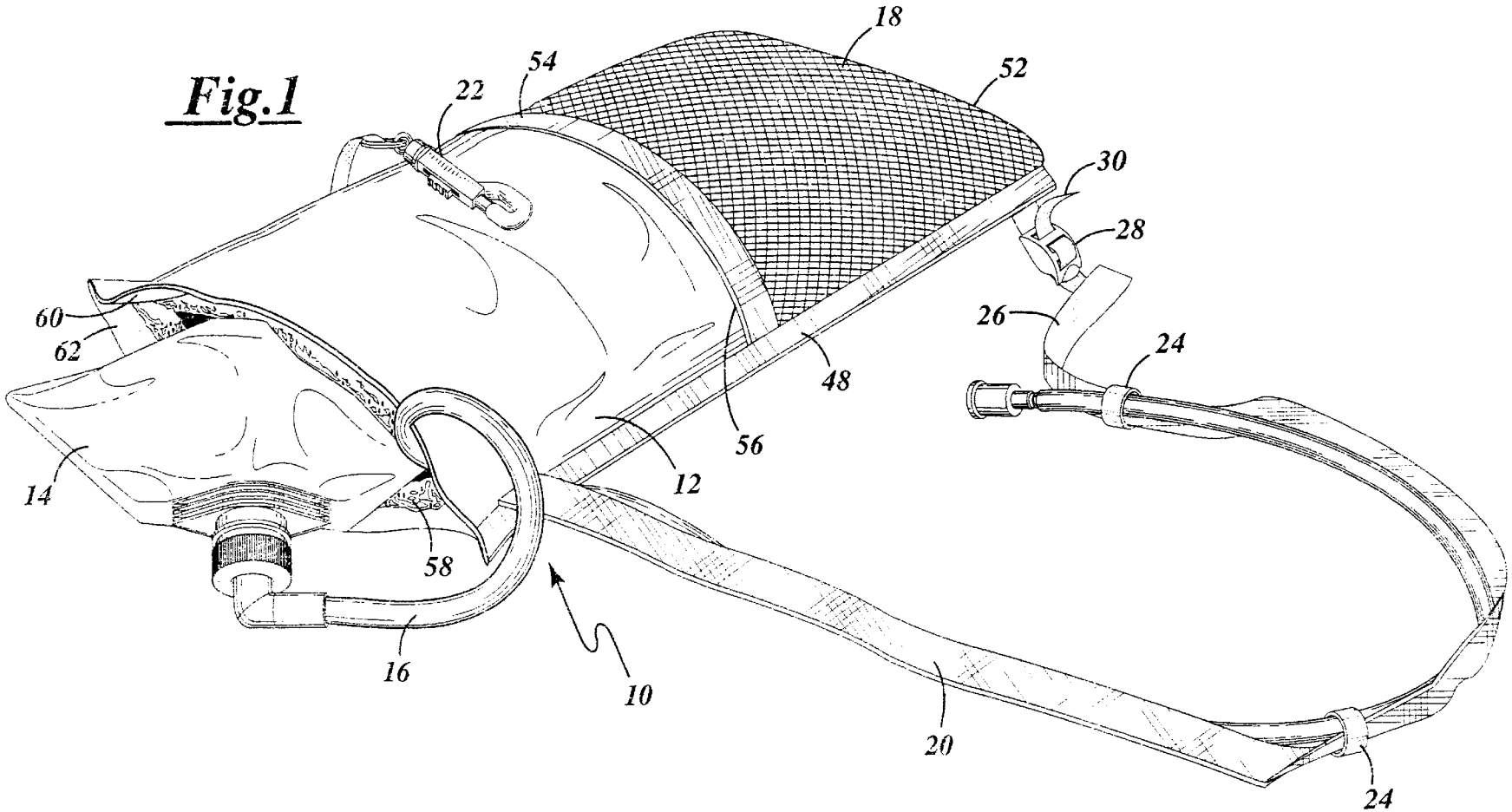
FIG. 1 is a perspective view of the versatile pillow of the present invention, showing the fluid pouch partially extending from an open end of the container.

In conjunction with the several views of the Figures, details of representative embodiments will next be presented. Referring first to FIG. 1, there is shown generally a versatile pillow 10 having the novel features of the present invention. The versatile pillow 10 includes a container 12, fluid pouch 14, and fluid conduit or tube 16. Attached to the container 12 is an expandable pocket 18, handle 20, and key chain 22. The tube 16 may be secured to the handle 20 with tie downs 24 or other fastener of known suitable construction. A free end 26 of the handle 20 includes a buckle member 28 suitable for attaching to a strap 30 affixed to the container 12.

Figure 2:
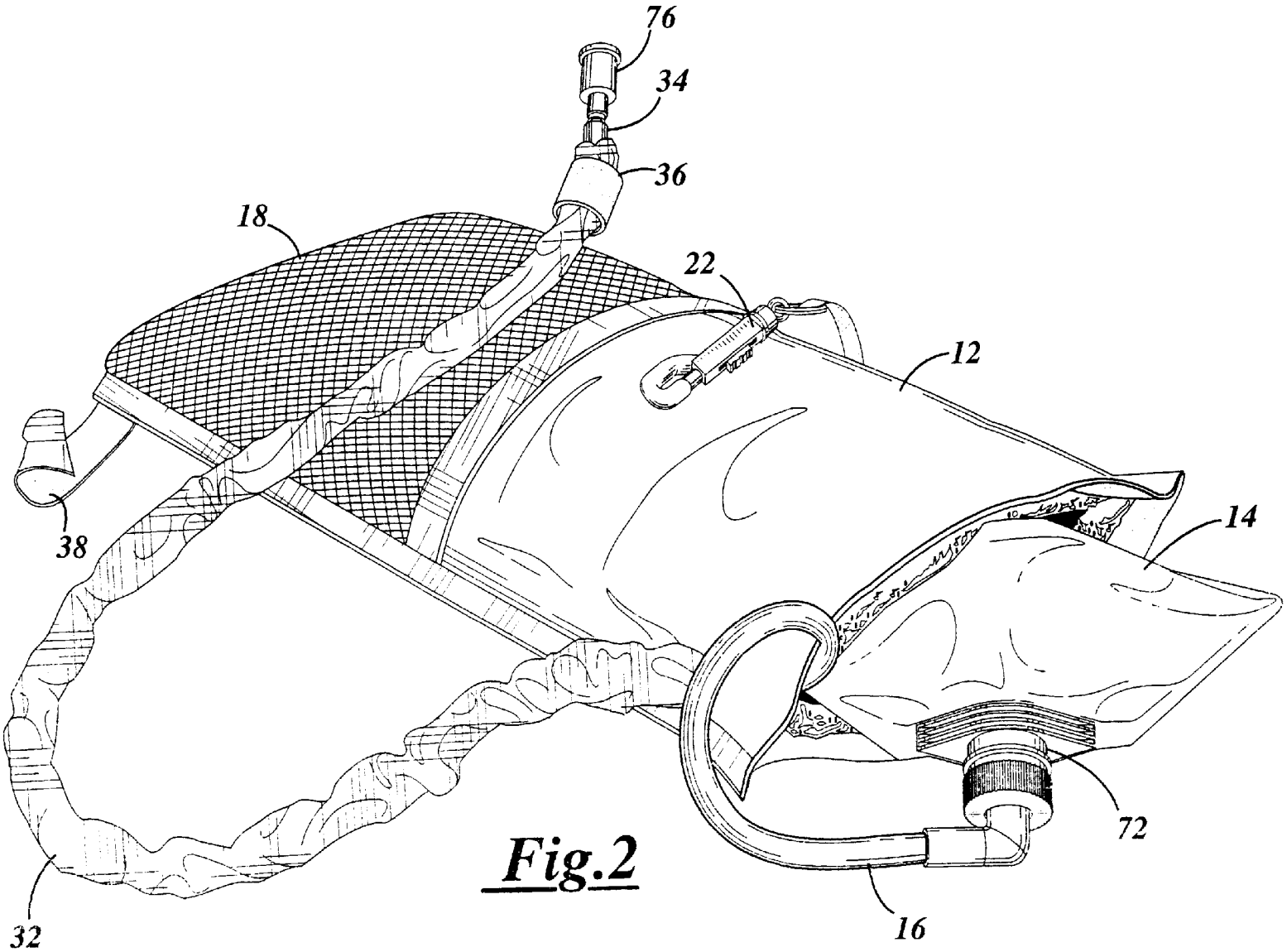
FIG. 2 is a perspective view of an alternate embodiment of the versatile pillow of the present invention, showing the fluid conduit concealed within an internal passage of the handle.
Figure 3:
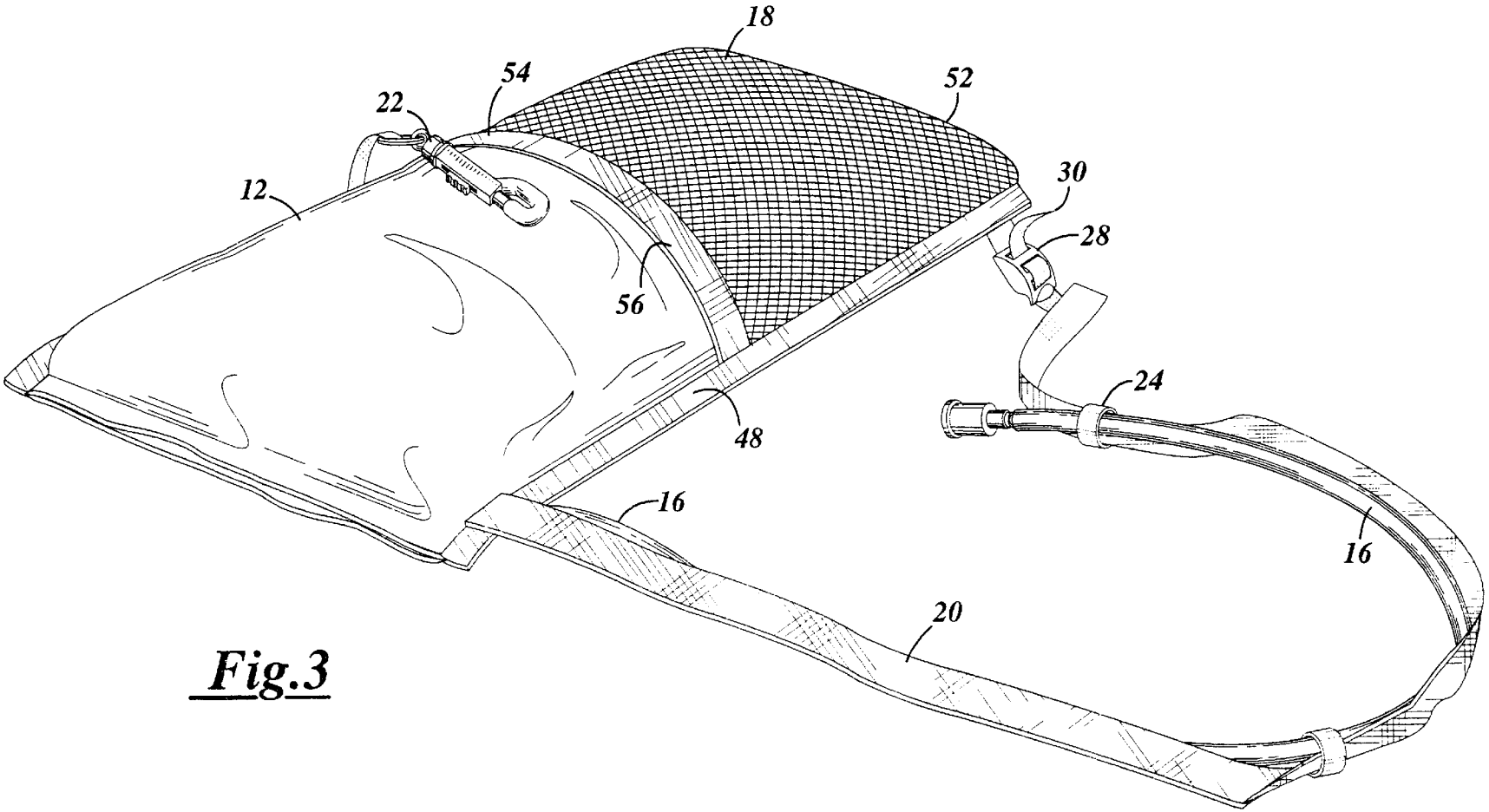
FIG. 3 is a perspective view of the versatile pillow of the type shown in FIG. 1, having the open end fastened closed.

FIG. 2 shows an alternate embodiment wherein a major portion of the tube 16 concealed within an internal passage of a handle 32. A free end 34 of the tube 16 extends out of the handle 32. The handle 32 includes a hook portion 36 of a hook and loop type fastener, attached to a free end of the handle 32, wherein the hook portion 36 mates with a loop portion 38 affixed to the container 12. Of course, other fastening means of known suitable construction may be utilized to removably attach the free end of the handle 20 or 32 to the container 12.

Figure 4:
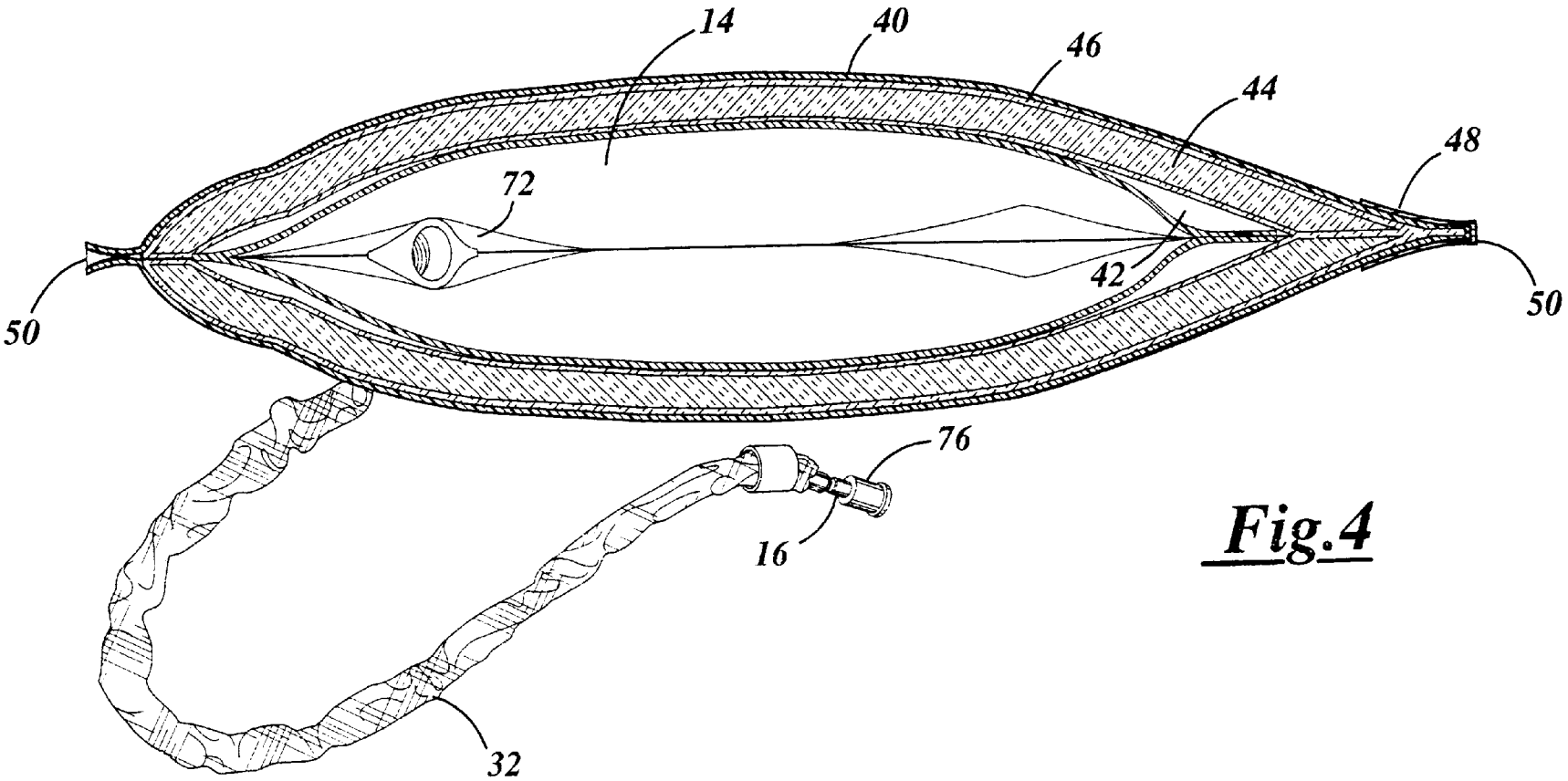
FIG. 4 is a partial sectional end elevational view of the versatile pillow of the type show in FIG. 2.

Referring to FIG. 4, the container 12 includes a flexible exterior shell 40, interior liner 42, insulative pad 44, and additionally may include medium 46. Without any limitation intended, the exterior shell 40 is preferably manufactured from a water repellant material, such as a woven nylon based fabric. The interior liner 42 is preferably manufactured from a thermal reflective, thin, flexible, metalized plastic film. The insulative pad 44 is preferably manufactured from an open cell low density foam, such as polyurethane ester. Of course those skilled in the art will appreciate that other materials of known suitable construction may be utilized without departing from the scope of the invention.

The exterior shell 40, insulative pad 44 and interior liner 42 may be attached together by a suitable adhesive or bonding means such as heat sealing or stitching. In an alternate embodiment, the medium 46 is preferably manufactured from a thermal reflective, thin, flexible, metalized plastic film and is attached to the exterior shell 40 and insulative pad 44 with a suitable known adhesive or bonding means. The medium 46 may act as an additional thermal barrier. Those skilled in the art will appreciate that the various flexible "layers" of the container may be formed from continuous sheets of the desired materials or may be constructed of several subparts. Further, it may be desirable to attach the exterior shell 40 and inner liner 42 in a known suitable manner such that the insultative pad 44 may be removed and replaced. The outer edge of the container 12 may include a casing member 48 that encases the perimeter edge 50 of the exterior shell 40 and interior liner 42.

Figure 5:
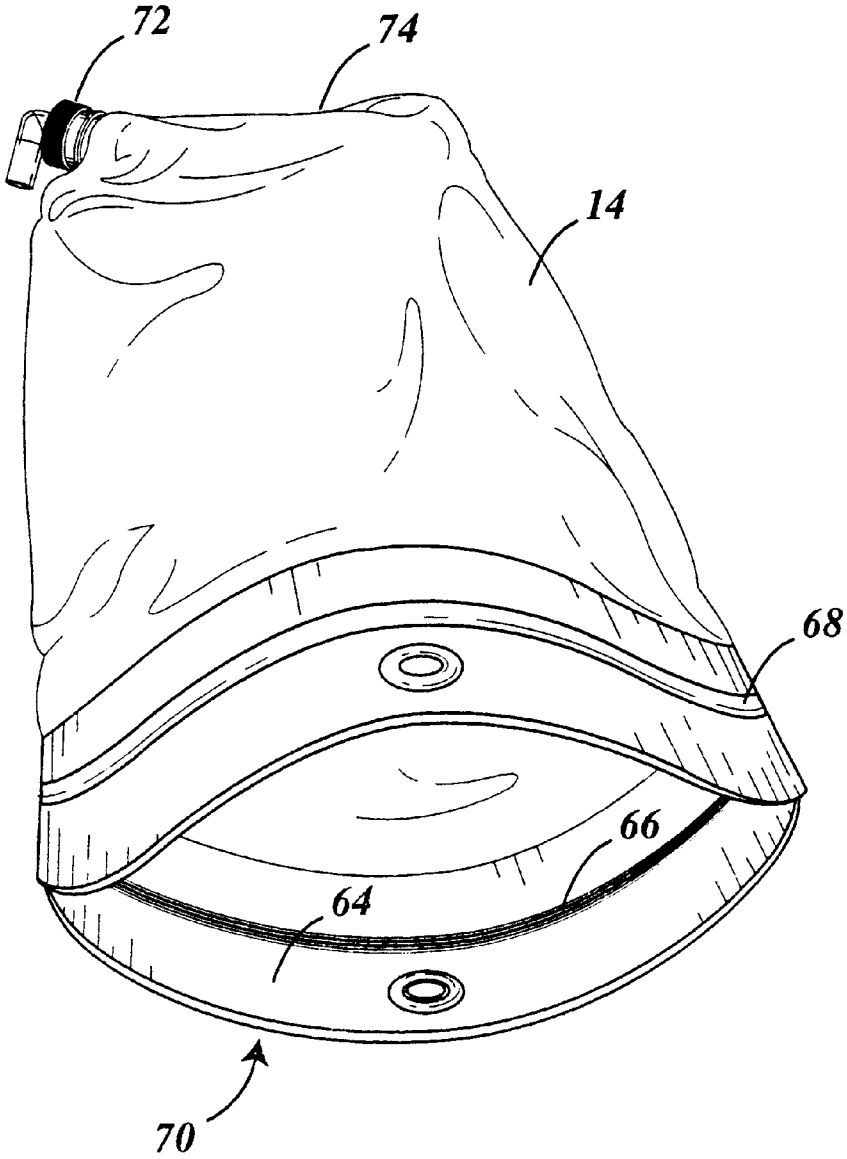
FIG. 5 is a fragmentary perspective end view of the fluid pouch of the type shown in FIG. 1, removed from the container.

Referring now to FIG. 5, an alternate inlet 64 of the plastic fluid pouch 14 is shown in greater detail. The inlet 64 includes mating, resealable tongue 66 and groove 68 members positioned proximate the inlet proximate the bottom end 70 of the fluid pouch 14, thereby providing a means for sealing the inlet 64 of the fluid pouch 14. Those skilled in the art will appreciate that the bottom end 70 may be permanently closed, wherein a threaded opening 72 formed in a top portion 74 of the fluid pouch 14 serves as both the inlet and outlet of the fluid pouch. The fluid conduit or tube 16 is sealably attached to the opening 72, whereby fluids may be drawn out of or forced into the fluid pouch 14 through the tube 16. A valve 76 is engaged to the free end 34 of the tube as is of the type that may be actuated from a closed to open position by applying an inward pressure to an outer wall of the valve 76. Without limitation, a suitable fluid pouch, tube and valve are available from AJC Enterprises, Westminister, Colo., and/or Cascade Designs, Inc. of Seattle, Wash., and/or other known suitable manufacturers.

Referring again to FIG. 1, the pocket 18 may be constructed of an expandable mesh fabric 52 and may include a resilient type band 54 attached to an open end 56 of the pocket 18. The resilient band 54 tends to draw the adjacent mesh fabric 52 inward towards the container 12, thereby effectively closing the open end 56 of the pocket 18. Also, the open end of the pocket may be secured to the exterior shell by known suitable means. The exterior shell 40, interior liner 42, and insulative pad 44 of the container 12 are attached together leaving an open end 58. Attached to the perimeter of the open end 58 are hook and loop portions 60 and 62 of a fastener, which allow the open end 58 to be securely closed. Those skilled in the art will appreciate that snaps, rivets, buttons, zippers, straps, or other fastening mechanisms of known suitable construction may be used to securely close the open end 58 when desired.

Having described the constructional features of the present invention, the mode of use will next be presented. The user may fill the fluid pouch with a desired liquid through opening 72 or inlet 64. Once the fluid pouch is filled with liquid, the inlet 64 (if present) is sealed and the tube 16 is sealably attached to the opening 72. The valve 76 remains in the closed position, unless actuated open by the user, thereby preventing the liquid from draining out of the fluid pouch 14. The user may then place the container under the head and neck for support. When the user desires liquid from the fluid pouch, the user may bite on the valve 76, thereby applying an inward pressure and actuating the valve 76 open. The user may likewise blow air into the tube while actuating the valve open in order to increase the firmness of the container 12.

This invention has been described herein in considerable detail in order to comply with the patent statutes and to provide those skilled in the art with the information needed to apply the novel principles and to construct and use such specialized components as are required. However, it is to be understood that the invention can be carried out by specifically different devices, and that various modifications, both as to the equipment details and operating procedures, can be accomplished without departing from the scope of the invention itself.

What is claimed is:

1. A versatile pillow combination having application as both a head support and a beverage dispenser, said pillow combination including:

(a) a container having an exterior shell, a beverage pouch retaining interior liner, and an insulative pad positioned between the exterior shell and the interior liner, wherein said interior liner defines an inner hollow region within said exterior shell, said inner hollow region further having an open end for access through said exterior shell to the inner hollow region and a means for closing said open end;

(b) a beverage retaining pouch adapted to be positioned within the inner hollow region of said container;

(c) a beverage transmitting tube coupled to said beverage retaining pouch and in communication with said beverage retaining pouch through an outlet formed in said beverage retaining pouch and with the beverage transmitting tube extending out of said container;

(d) a valve coupled to a free end of said transmitting tube and controllably actuated between an open and closed position, thereby controlling the inflow and outflow of beverages through said transmitting tube and said beverage retaining pouch, and wherein the tube is coupled to a handle, said handle being attached to the exterior shell of said container.

2. The pillow combination as recited in claim 1, wherein said tube is further enclosed within an interior passage of said handle.

3. The pillow combination as recited in claim 2, wherein said interior liner is constructed of material having properties sufficient to form a thermal barrier between the insulative pad and inner hollow region of said container.

4. A versatile pillow combination having application as both a head support and a beverage dispenser, said pillow combination including:

(a) a container having an exterior shell, a beverage pouch retaining interior liner, and an insulative pad positioned between the exterior shell and the interior liner, wherein said interior liner defines a hollow inner region within said exterior shell, said hollow inner region further having an open end for access through said exterior shell to the hollow inner region and a means for closing said open end, said interior liner being constructed of material having properties sufficient to form a thermal barrier between the insulative pad and hollow inner region of said container;

(b) a beverage retaining pouch adapted to be positioned within the hollow inner region of said container;

(c) a beverage transmitting tube coupled to said beverage retaining pouch and in communication with said beverage retaining pouch through an outlet formed in said beverage retaining pouch and with the beverage transmitting tube extending out of said container, said beverage transmitting tube being coupled to a handle, said handle being attached to the exterior shell of said container; and (d) a valve coupled to a free end of said transmitting tube and controllably actuated between an open and closed position, thereby controlling the inflow and outflow of beverages through said transmitting tube and said beverage retaining pouch.

5. The pillow combination as recited in claim 4, wherein said tube is further enclosed within an interior passage of said handle.

6. The pillow combination as recited in claim 5,further including a medium positioned between the exterior shell and the insulative pad, said medium having properties sufficient to form a thermal barrier between the exterior shell and the insulative pad.

7. A versatile pillow combination having application as both a head support and a beverage dispenser, said pillow combination including:

(a) a container having an exterior shell, a beverage pouch retaining interior liner, and an insulative positioned between the exterior shell and the interior liner, wherein said interior liner defines a hollow inner region within said exterior shell, said hollow inner region further having an open end for access through said exterior shell to the hollow inner region and a means for closing said open end, said interior liner being constructed of material having properties sufficient to form a thermal barrier between the insulative pad and hollow inner region of said container;

(b) a medium positioned between the exterior shell and the insulative pad having properties sufficient to form a thermal barrier between the exterior shell and the insulative pad;

(c) a beverage retaining pouch adapted to be positioned within the hollow inner region of said container;

(d) a beverage transmitting tube coupled to said beverage retaining pouch and in communication with said beverage retaining pouch through an outlet formed in said beverage retaining pouch and with the beverage transmitting tube extending out of said container, wherein said tube is coupled to a handle, said handle being attached to the exterior shell of said container; and (e) a valve coupled to a free end of said transmitting tube and controllably actuated between an open and closed position, thereby controlling the inflow and outflow of beverages through said transmitting tube and said beverage retaining pouch.

8. The pillow combination as recited in claim 7, wherein said tube is further enclosed within an interior passage of said handle.

* * * * *